United States Patent [19]

Sireix

[11] Patent Number: 4,648,859

[45] Date of Patent: Mar. 10, 1987

[54] APPARATUS FOR APPLYING A SEALING MATERIAL TO THE EDGE OF A LENGTH OF PACKAGING

[76] Inventor: Georges Sireix, 9, rue Saint-Marc, 68400 Riedisheim, France

[21] Appl. No.: 451,953

[22] Filed: Dec. 21, 1982

[30] Foreign Application Priority Data

Dec. 23, 1981 [FR] France ..... 81 24260

[51] Int. Cl.[4] ..... B31B 1/90

[52] U.S. Cl. ..... 493/105; 493/102; 493/104; 493/108; 493/128; 493/141; 53/563; 413/2; 413/7; 413/45; 413/50; 156/69; 156/567

[58] Field of Search ..... 493/105, 102, 104, 103, 493/106, 107, 108, 109, 131, 132, 152, 153, 128, 130, 141, 295, 297, 305, 47; 53/563; 413/2, 3, 7, 45, 50; 414/225, 226, 736; 156/69, 291, 578, 567; 29/355, 809

[56] References Cited

U.S. PATENT DOCUMENTS

| | | | |
|---|---|---|---|
| 1,429,324 | 9/1922 | Carle | 493/105 |
| 2,354,068 | 7/1944 | Schmitt | 413/50 |
| 2,479,050 | 8/1949 | Sidebotham | 493/105 |
| 2,726,583 | 12/1955 | Barnes et al. | 493/102 |
| 3,102,182 | 8/1963 | Oelze et al. | 156/69 |
| 3,604,320 | 9/1971 | Duvall | 493/109 |
| 3,739,695 | 6/1973 | Peacock | 493/109 |
| 4,295,838 | 10/1981 | Richards et al. | 493/105 |

*Primary Examiner*—Lowell A. Larson
*Assistant Examiner*—David B. Jones
*Attorney, Agent, or Firm*—Darby & Darby

[57] ABSTRACT

The invention relates to a device which seals a base or a lid onto a length of section and in particular to apparatus for sealing tubular section used as packaging and obtained by adhesion of several strips of fibrous, cellulosic, metallic, plastic and other materials.

12 Claims, 28 Drawing Figures

XII
XII

APPARATUS FOR APPLYING A SEALING MATERIAL TO THE EDGE OF A LENGTH OF PACKAGING

BACKGROUND OF THE INVENTION

A process is known from French patent No. 80.05684 for shaping sections, more especially tubular sections obtained by the adhesion of several strips of fibrous, cellulosic, metallic, plastic and other materials, the one laterally staggered in relation to the other. In accordance with this known process, the assembling of strips, which are previously coated with adhesive on at least one surface, is initially achieved over a narrow width, and then extended to the entire perimeter of the tubular section being shaped. The assembly process consists of a helicoidal progression created by the combination, on the one hand, of the lateral extension of the width of assembly and on the other hand, by the continuous advancing of all the strips so as to achieve lateral deployment of one strip in relation to another progressively with continuous shaping of the tubular section.

A machine is also known, from French patent No. 80.08667, for the continuous shaping of tubular section made from several strips stuck together, such strips being of fibrous, cellulosic, metallic, plastic and other materials. This machine accomplishes the shaping process indicated above and comprises an adhesive unit fitted with a labeling assembly, followed by a press to ensure partial adhesion of the different strips over a narrow width, while the ends of the strips remain independent of one another. This machine also incorporates a shaping device acting together with a feeding and gripping mechanism to continue and broaden the adhesion area, and a succession of twin-wheel pressure assemblies to assist the adhesion of the strips snugly edge-to-edge. At its discharge point, the machine comprises a multi-cut periphery cutting device accompanied by a device for discharging the severed lengths of tubular section.

SUMMARY OF THE INVENTION

The present invention improves upon automated equipment adapted for the continuous manufacture of packaging of the type described above, by sealing a base or a lid onto edges of the length of tubular section being formed. To this end, there is provided apparatus consisting of a frame defining a base on which is incorporated the various mechanical, electric, electronic, pneumatic and other components causing the machine to function. The frame includes two parallel vertical supports arranged at the two ends of the base for carrying a rotatable drum of polygonal section, each facet of which, being fitted with means for gripping and holding lengths of tubular section, acts successively with detachable assemblies arranged concentrically in relation to the drum continuously to fix a base or a lid onto one of the edges of the lengths of tubular section carried by the drum.

The foregoing arrangement has the advantage, among others, that the same machine can serve to attach a base or a lid to a length of tubular section irrespective of its cross-sectional configuration (i.e., rectangular, triangular, hexagonal, octagonal or circular) and by different connective techniques such as cold process adhesion, hot process adhesion, heat fusion, high-frequency and/or ultrasonic, conduction, reactivation, rotation or crimping. All that is required is to replace the means for gripping and holding the lengths of section on the drum and any of the detachable assemblies surrounding the drum by other means of gripping and other such assemblies as desired.

BRIEF DESCRIPTION OF THE DRAWINGS

For a further understanding of the present invention, reference may be had to the accompanying drawings in which.

Figures 12, 13, 16:
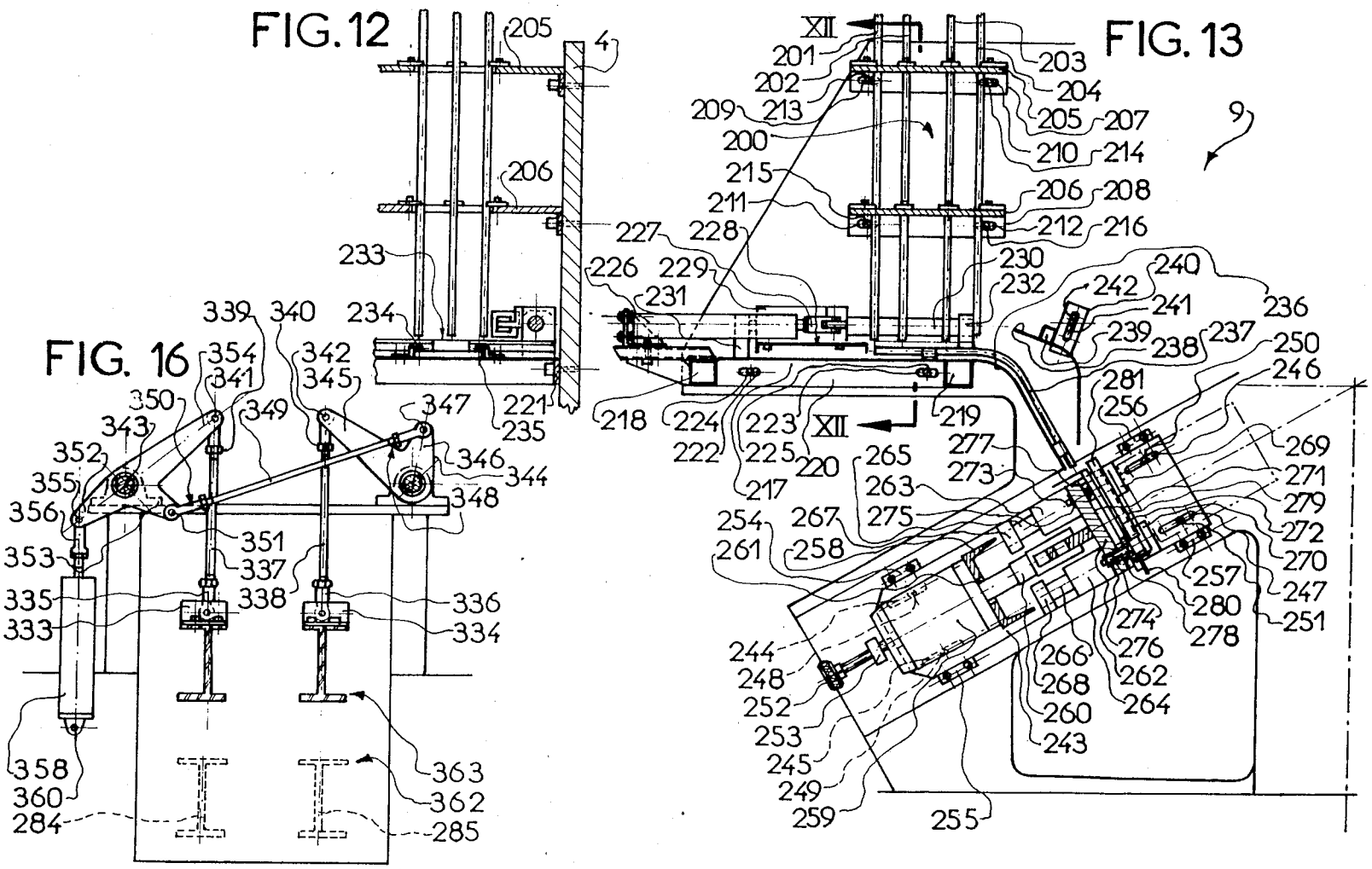
FIG. 12 is a view taken along the line XII—XII of FIG. 13.
FIG. 13 is a front sectional view of the base input and positioning assembly.
Figure 17:
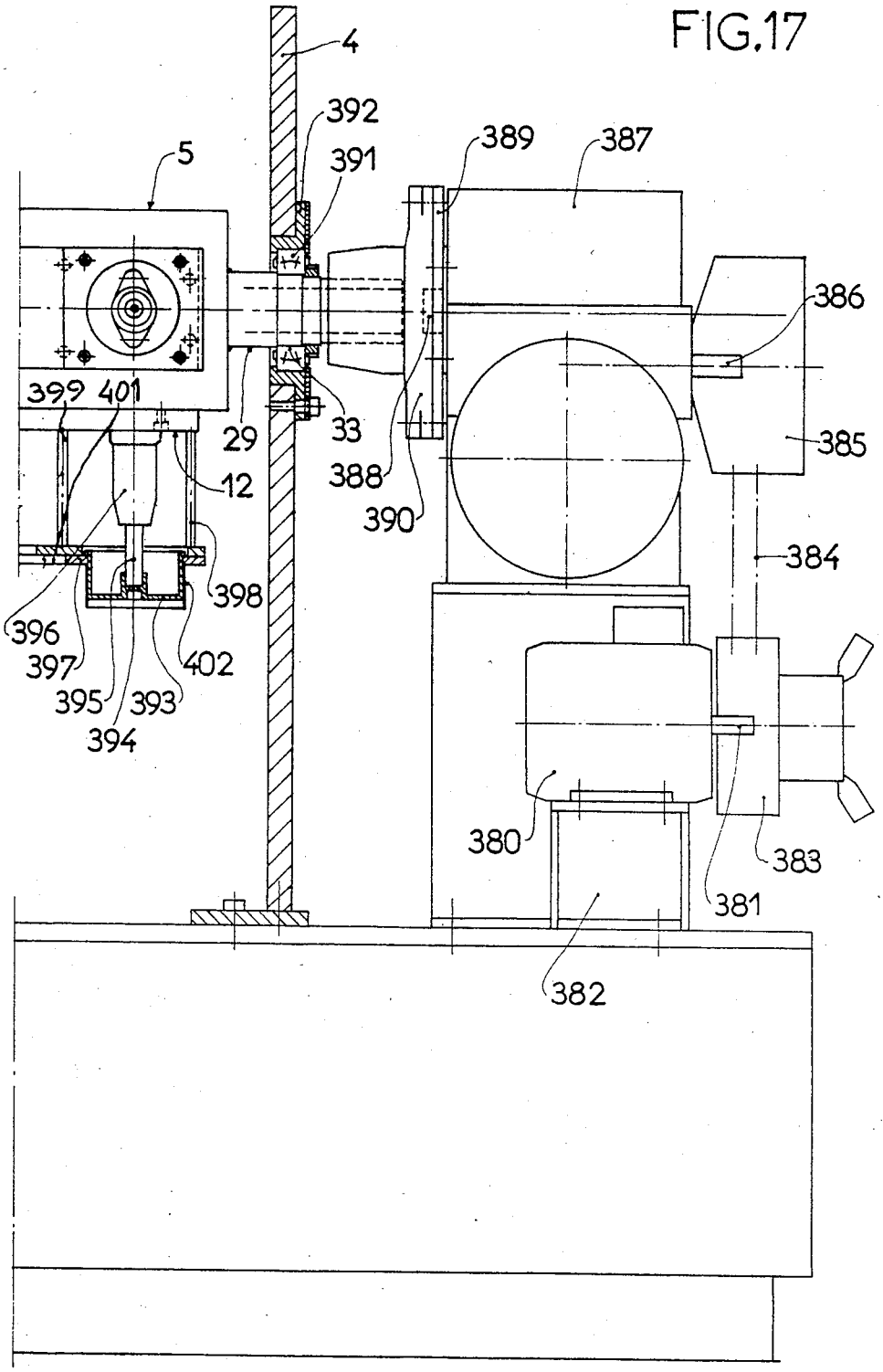
Figure 18:
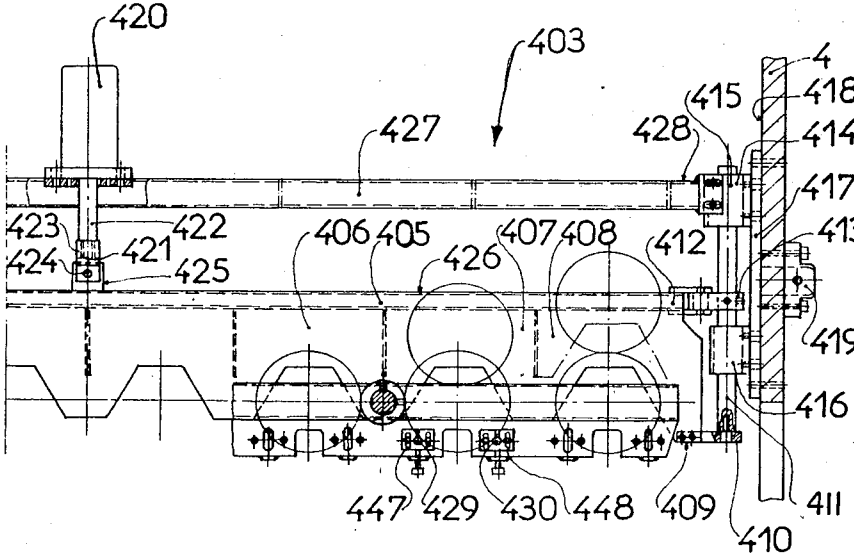

. 15 is a front sectional view of the discharge assembly for tubular section lengths with base fitted;

FIG. 16 is a sectional view of the discharge assembly conveyors control mechanism;

FIG. 17 is a sectional view of the motor facilities together with the means for gripping and holding lengths of tubular section of circular cross-section;

FIG. 18 is a sectional view of the input and positioning assembly for the rings forming the shell of the circular packaging of FIG. 17.

Figure 19:
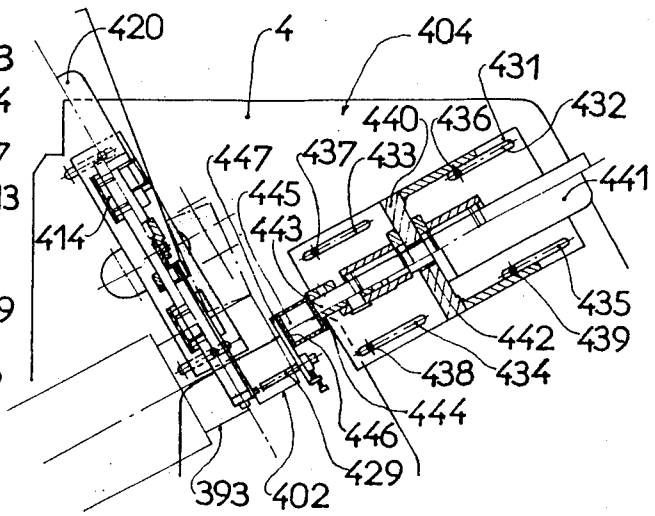
Figure 20:
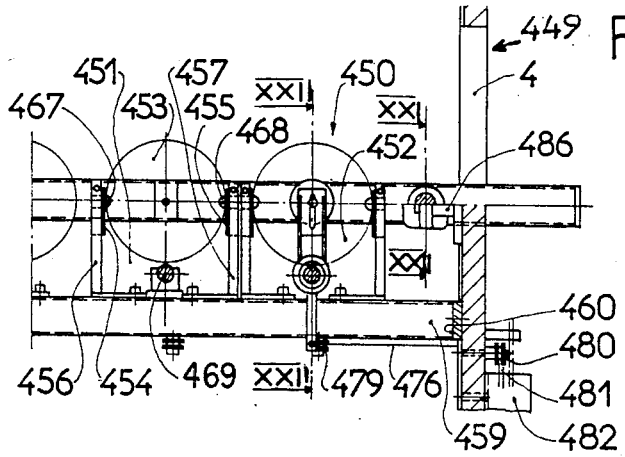
Figure 21:
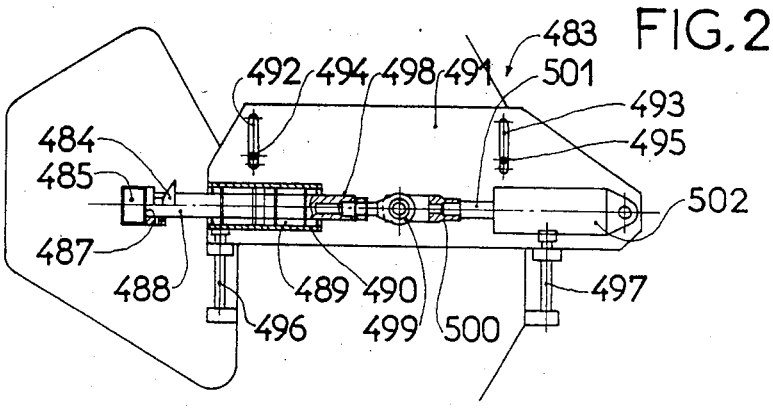
Figure 22:
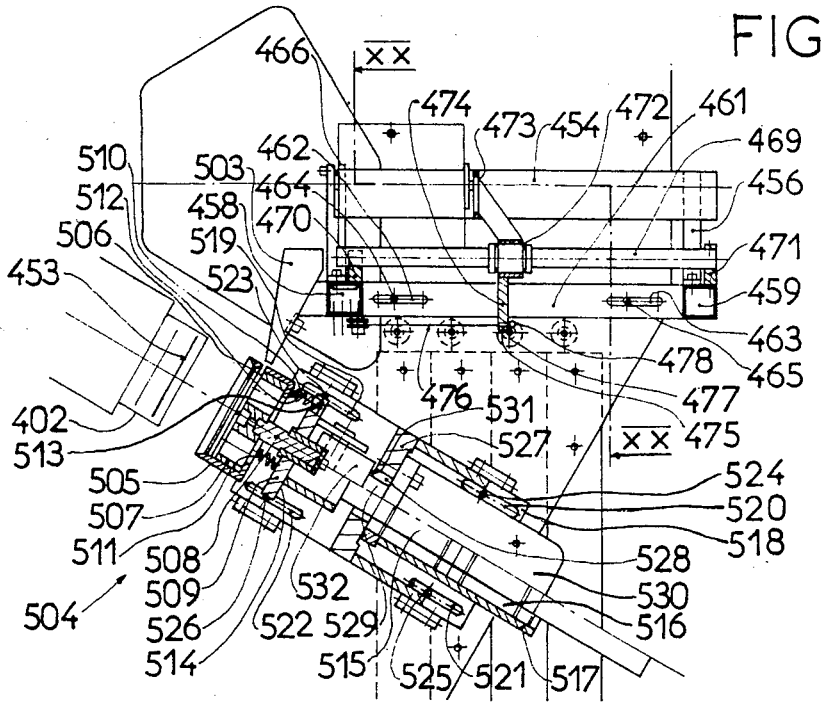
Figure 24:
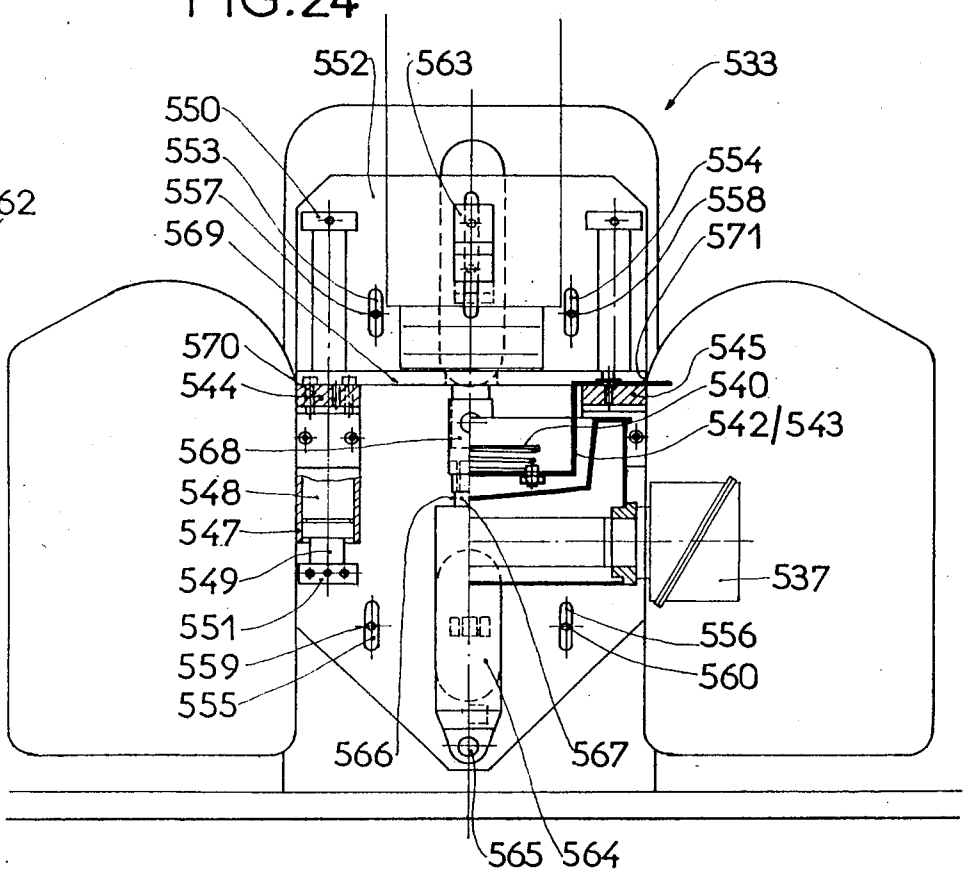
Figure 23:
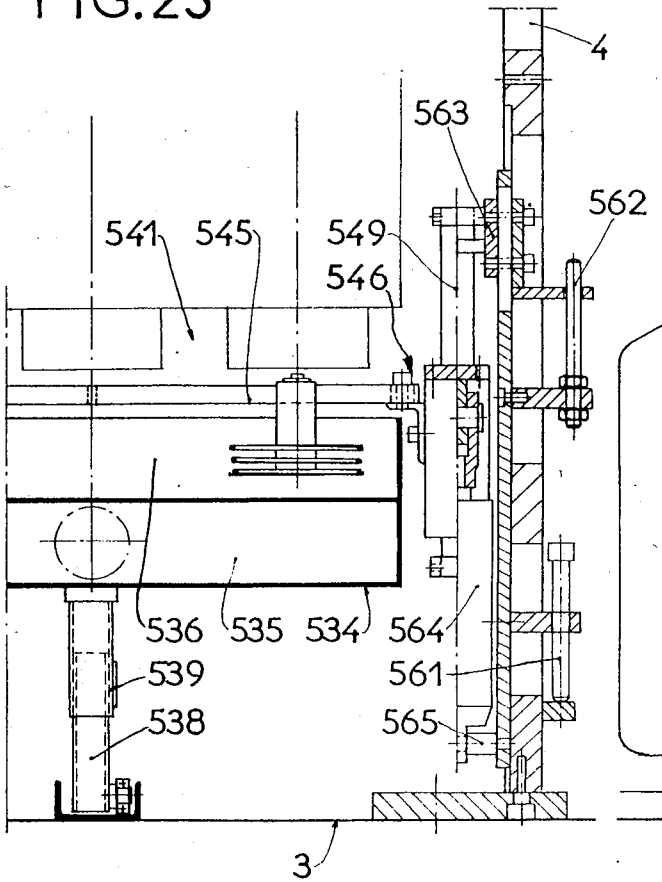
Figure 26:
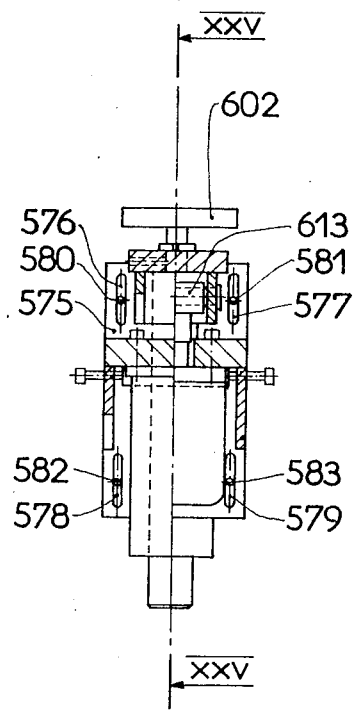
Figure 25:
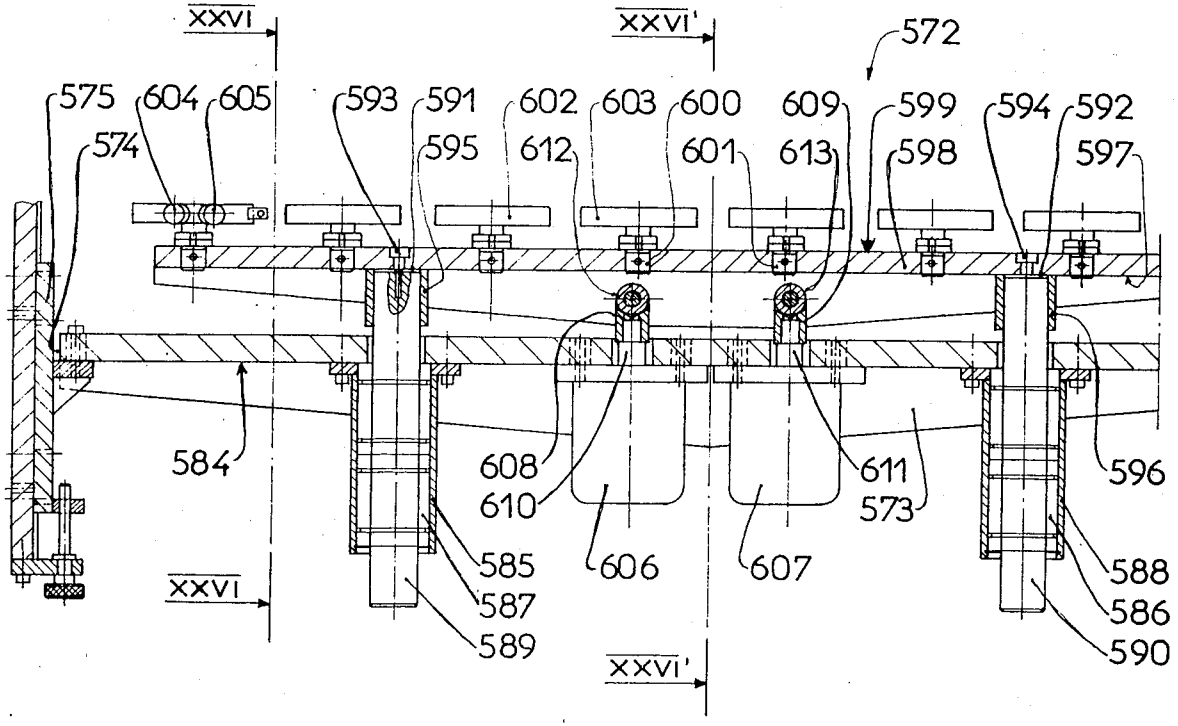
Figure 27:
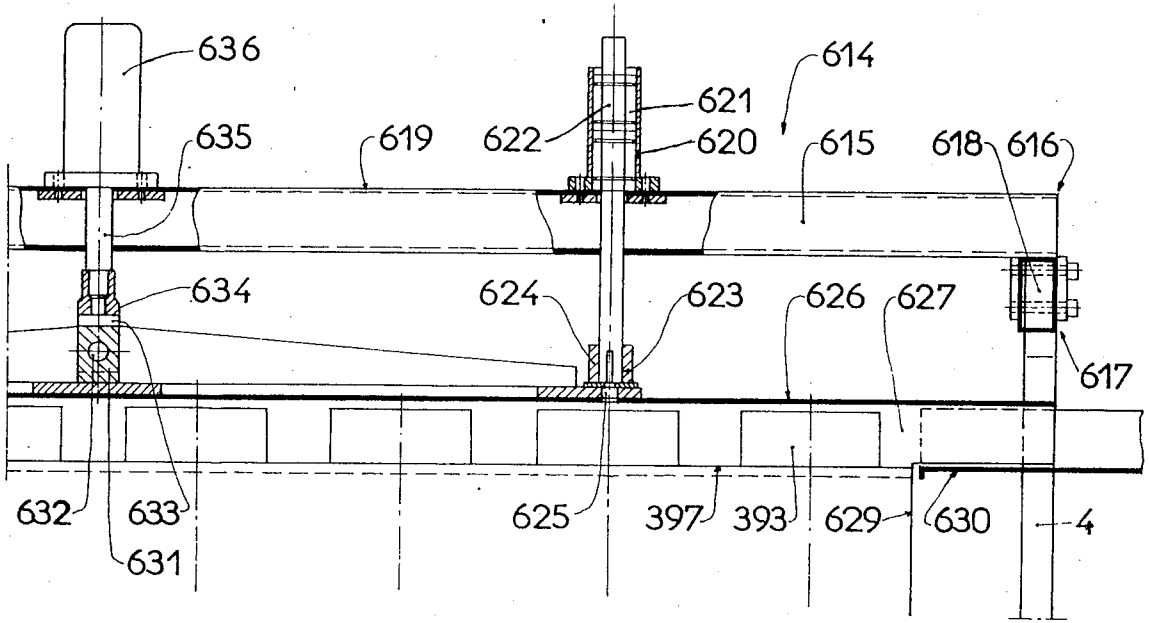

FIG. 19 is a sectional side view of the input and positioning assembly of FIG. 18;

FIG. 20 is a sectional view of the feed and positioning assembly for discs to be used as base or lid for the rings;

FIG. 21 is a view taken along the line XXI—XXI of FIG. 20;

FIG. 22 is a view taken along the line XXI—XXI of FIG. 20;

FIG. 23 is a sectional view of the adhesion assembly;

FIG. 24 is a sectional side view of the adhesion assembly of FIG. 23;

FIG. 25 is a sectional view of the pre-crimping and final crimping assemblies;

FIG. 26 is a view taken along the line XXVI—XXVI of FIG. 25;

FIG. 27 is a sectional view of the discharge assembly; and

Figure 28:
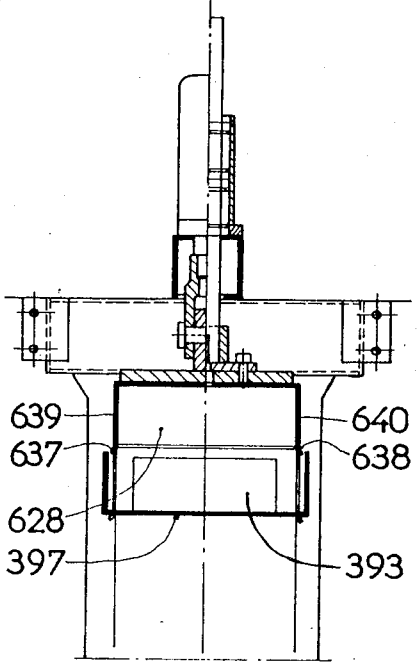

FIG. 28,is a sectional side view of the discharge assembly.

BRIEF DESCRIPTION OF THE PREFERRED EMBODIMENTS

Figure 1:
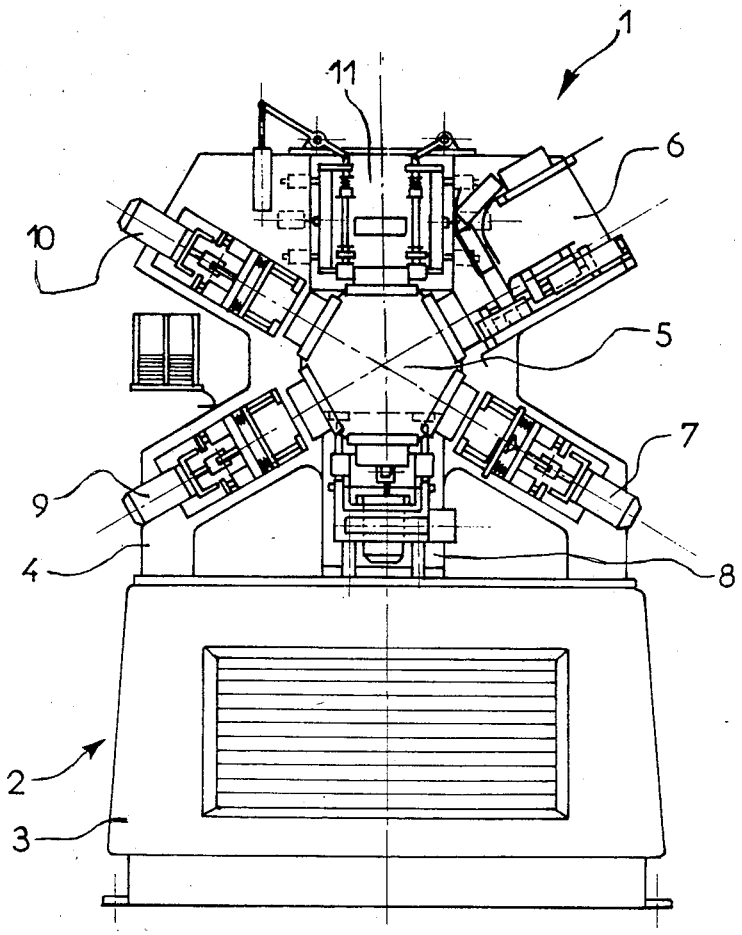
FIG. 1 is a front elevational view of the present sealing machine, the front support being removed.

With reference now to FIG. 1, there is depicted a machine 1 for continuously sealing a base on one of the edges of a length of tubular section obtained by adhesion of several strips of fibrous, cellulosic, metallic, plastic and other materials. The machine 1 comprises a frame 2 consisting of a base 3, incorporating the different mechanical, electrical, electronic, pneumatic and other apparatus contributing to the functioning of the machine, and two parallel vertical supports 4 arranged at the two ends of the base and firmly attached thereto by any suitable means. Between these two supports 4 are arranged a drum 5 of polygonal cross-section subject to cyclical rotating movement and several fixed assemblies 6, 7, 8, 9, 10, 11 (FIG. 1), 403, 404 (FIGS. 18 and 19), 449 (FIG. 20), 533 (FIG. 24), 572 (FIG. 25), 614 (FIG. 27) which can be interchanged as desired. Such fixed assemblies are arranged concentrically around the periphery of the drum 5. During operation, the drum, during its cyclical rotating movement, presents its different faces or facets in succession to each of the assemblies 6 to 11 or 403, 404, 449, 533, 572, 614, which in turn carry out certain predetermined work, described below.

According to a first exemplary mode of operation, the fixed assembly 6 may be adapted for the introduction into the machine 1 of a successive series of different lengths of tubular section of polygonal cross-section which are to be fitted with a base. Under such circumstances the fixed assembly 7 may be adapted for preshaping and heating the end of each length of tubular section on which a base is to be fitted. It is necessary to heat this end to maintain a certain fluidity in the adhesive until the base has been put on. In addition, it may well be that in the course of handling the different section lengths between discharge from the shaping machine to the machine 1, the ends of the sections may be distorted. If so, it will be necessary to restore each distorted end to its initial shape. To accomplish the necessary restoration the assembly 7 may also make the opening of each section length uniform to accommodate the necessity for the cross-section of all lengths of the same size to be strictly identical. If this uniformity is not maintained, there is a danger, either that the base to be applied will pass through the section opening, or that it will be placed at an angle such that assembly cannot be effected.

The assembly 8 may be an adhesion assembly. In this assembly, the adhesive is applied to the edge of the section length. Assembly 9 may be adapted to deliver the base and place it in position to be suitably adhered to the section length. The assembly 10 may consist of a crimping assembly. However, where required, the crimping assembly may be withdrawn to enable the section length to be subjected at this position to an accelerated drying. Under the foregoing assembly arrangement, assembly 11 may be an assembly for discharge of the lengths which have been fitted with base.

Figure 3:
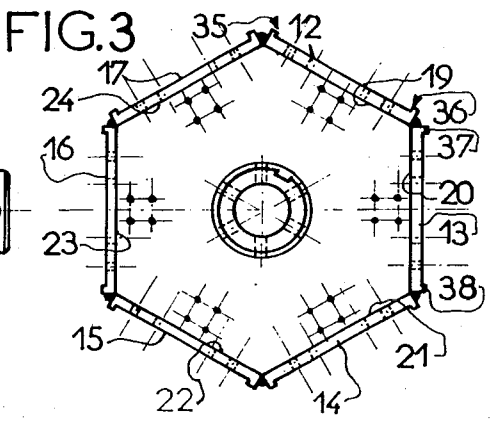
FIG. 3 is a side view of the drum.
Figure 2:
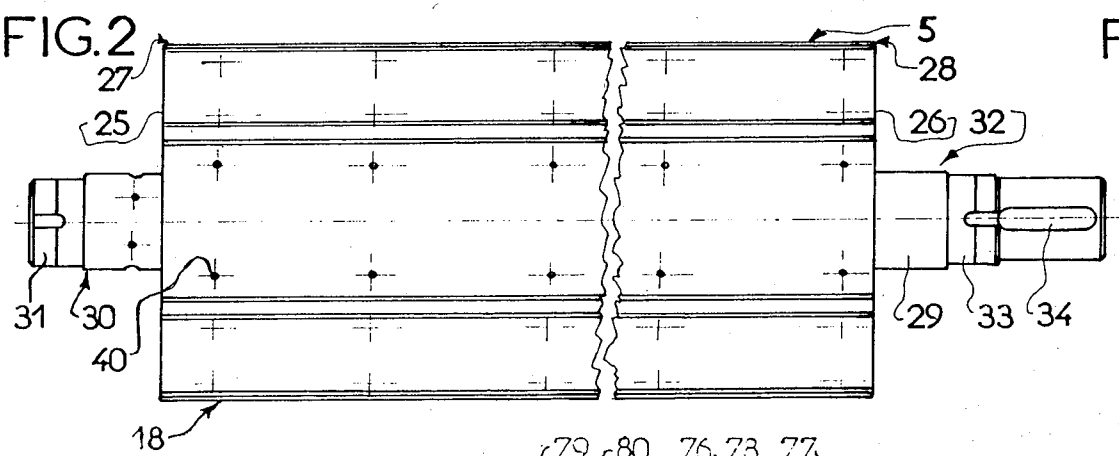
FIG. 2 is a plan view of the drum.

Referring now to FIGS. 2 and 3, it appears that the drum 5 may be provided with a polygonal periphery having substantially planar surfaces 12, 13, 14, 15, 16, 17. In the present embodiment, the drum 5 is shown to have an hexagonal cross-section and in the course of operation each flat surface 12 to 17 in succession is opposite one of the assemblies 6 to 11 enumerated above. Other cross-sectional configurations may be utilized for the drum 5 as desired. Generally, the drum 5 consists of a shell 18 formed of six panels 19, 20, 21, 22, 23, 24 made integral one with the other by any suitable means. A pair of lateral discs 25, 26, may be utilized to close off the ends 27, 28 of the shell 18. A shaft 29 supports the drum, one end 30 of which has a ball-bearing race 31 for a bearing integral with the center of the supports 4. The other end 32 of the shaft comprises, in addition to an identical ball-race 33 for the other bearing, an element such as a key 34 to make the drum rotate. At the ends 35, 36 of the drum, each flat surface 2 to 17 has a longitudinal projection 37, 38. A series of gripping devices 39 (FIGS. 4 and 5), held by any means 40, are fitted between such longitudinal projections. The gripping devices 39 preferably consist of a base plate 41 seated between the projections 37, 38. The inside face 42 of the base plate 41 has a groove 43 acting as a duct for a fluid such as compressed air. The groove 43 is closed off by an hermetic lid 44 fitted in a seat 45 terminating at the groove 43 and held in place by retaining devices 46, 47. The groove 43 is linked to a fluid distribution system (not shown) by an orifice 48 in the base plate 41.

In another connection, the groove 43 is linked by apertures 49, placed at regular intervals, to jacks 50 preferably pneumatic, made integral with the top 51 of the base plate 41 by retaining elements 52, 53, 54, 55. Each pneumatic jack 50 is surrounded by a set of vertical axes 56, 57, 58, 59, made of a flexible material and kept integral with the top 51 of the base plate 41 by a central retaining element 60, 61. The number of such vertical axes 56 to 59 is a function of the cross-section of the length of tubular section which has to be provided with a base. Accordingly, in the case of a circular cross-section, they number three, whereas, for a square or rectangular cross-section, there are four.

Facing the pneumatic jack 50, the vertical axes 56 to 59 have flat parts 62, 63, 64, 65 which serve as a supporting surface for horizontal bearings 66, 67 having threads 68, 69 for the insertion of retaining elements sunk into horizontal recesses 70, 71 provided in the axes 56 to 59. The bearings 66, 67, have respective surfaces 72, 73 facing one another and provided with inclined faces 74, 75. The inclined faces 74, 75 form between them a certain angle, the apex of which is above the bearings 66, 67. The two bearings opposite one another, 66, 67, are linked to one another by an elastic element 76, one end 77 of which is rigidly held by a retaining element 78 to the bearing 66. The other end 79 of the element 76 is rigidly held by a retaining element 80 to the bearing 67. The inclined faces 74, 75 act on a spacer 81 controlled by a regulating facility 82 fitted to the end 83 of a piston 84 of the pneumatic jack 50. Each of the axes 56 to 59 has a length which is machined down as indicated by reference numerals 86, 87, near to its bottom end.

In operation, the series of lengths of tubular section emanating from the input assembly 6 are slipped onto the assembly of vertical axes 56 to 59. The pneumatic jack 50 is activated and the piston 84 is pushed upwards. The spacer 81, acting with the inclined faces 74, 75, causes the bearings 66, 67 to move apart and consequently also the upper ends 88, 89 of the vertical axes 56 to 59. Such moving apart is made possible on the one hand, by the flexibility of the material of the axes 56 to 59 and, on the other hand, by the machined-down lengths 86, 87. In like manner, the elastic element 76 is stretched. Because of such moving apart, the length of tubular section is held and can no longer come off. To remove the length of tubular section after being fitted with a base, the piston 84 is caused to recede and the elastic element 76, through the intermediary of the bearings 66, 67, causes upper ends 88, 89 of the vertical axes 56 to 59 to come closer together.

Figures 6, 7:
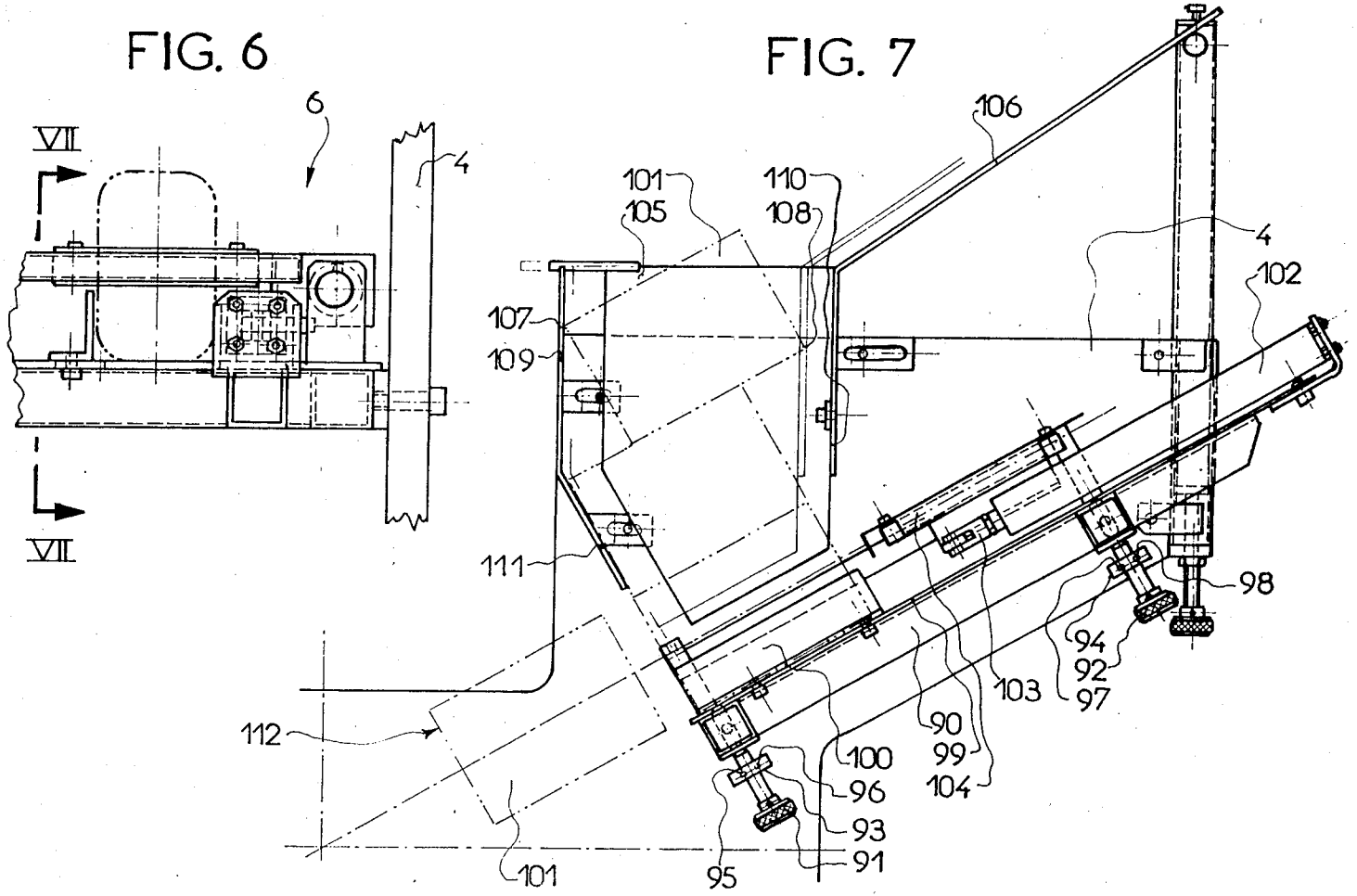
FIG. 6 is a sectional view of the input assembly for lengths entering the machine.
FIG. 7 is a view taken along the line VII—VII of FIG. 6.

With reference to FIGS. 6 and 7, the input assembly 6 comprises a supporting frame 90, the height and inclination of which may be altered by adjusting elements 91, 92 passing respectively through bearings 93, 94. Retaining elements 95, 96, 97, 98 rigidly secure the bearings 93, 94 to the support 4. A sheet-metal plate 99 extends from the support 4 to the other support, and is affixed to the supporting frame 90. The metal plate 99 acts as a support, on the one hand, for guides 100 between which a length of tubular section 101 is positioned, and on the other hand, to a jack 102, preferably penumatic, and which is rigidly fixed to the sheet 99 by an elbow support. A piston 103 of the jack 102 operates a driver 104 which is adapted to arrange each of a plurality of lengths of tubular sections 101 on the drum 5. The assembly 6 also includes a guide channel 105 fed by an inclined slipway 106.

Figure 5:
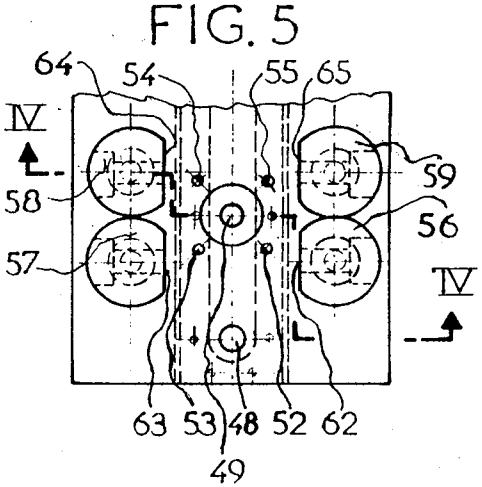
FIG. 5 is a plan view of the apparatus of FIG. 4.
Figure 4:
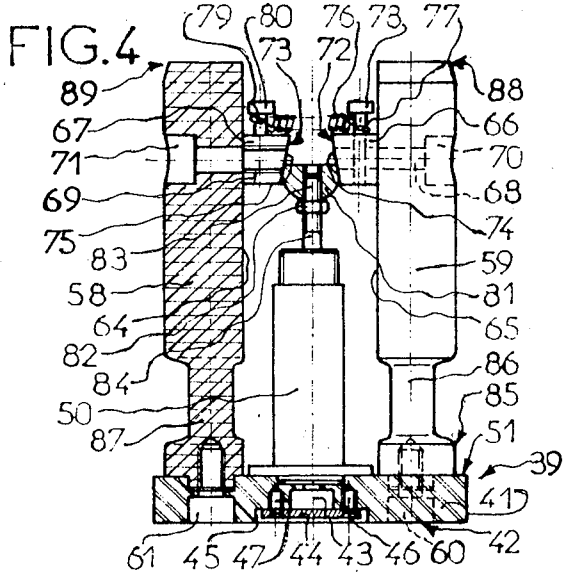
FIG. 4 is a sectional view of the means for gripping and holding lengths of tubular section of polygonal cross-section.

In operation, the various lengths or sections 101, fed in by some means arranged perpendicularly to the input assembly 6, slide down the slipway and fit into the guide channel 105. Diagnonally opposite corners 107, 108 of the sections 101 move along walls 109, 110, which can be brought nearer together or moved further apart according to the dimensions of the lengths or sections 101. The wall 109 has a guide 111 against which an edge 112 of the length 101 can move. The guide 111 directs the lengths 101 between the different guides 100. Then, the jack 102 is activated and the driver 104 moves the series of lengths 101 in the direction of the drum 5 in such a way that each length 101 covers an assembly of axes 56 to 59 (FIGS. 4 and 5). When the gripping devices 39 have acted, a rotation by a sixth of one revolution is involved for the present drum 5 in order to present the series of lengths 101 before the pre-shaping assembly 7.

Figure 9:
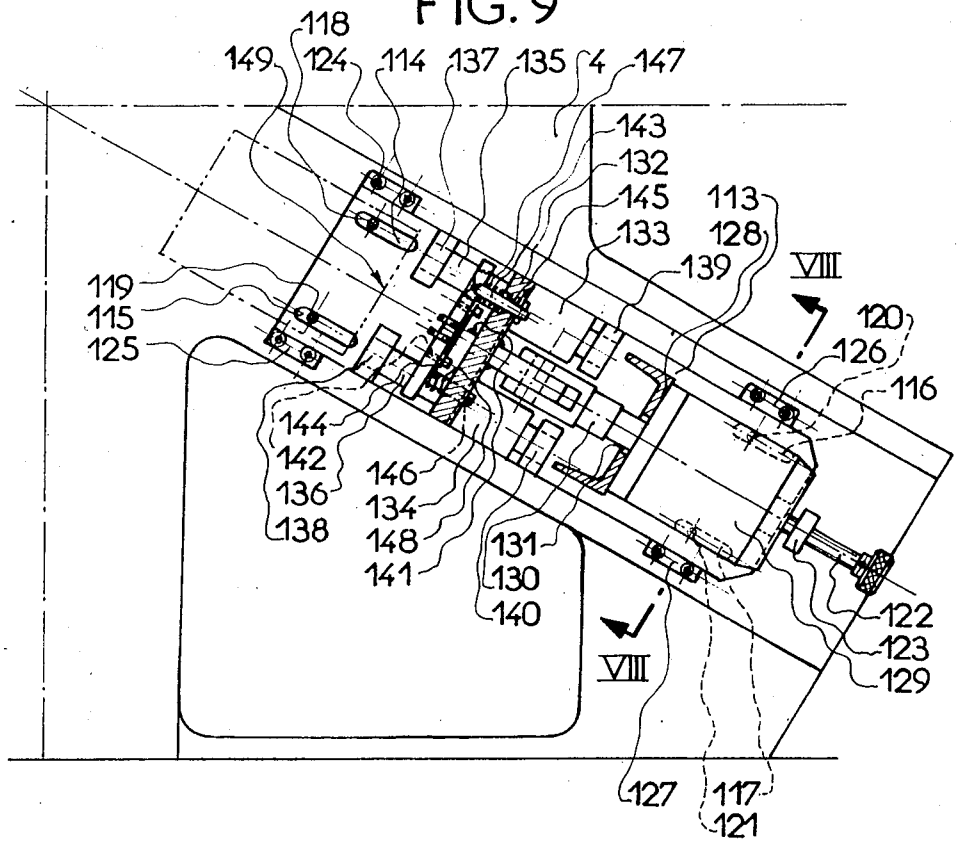
FIG. 9 is a view taken along the line IX—IX of FIG. 8.
Figure 8:
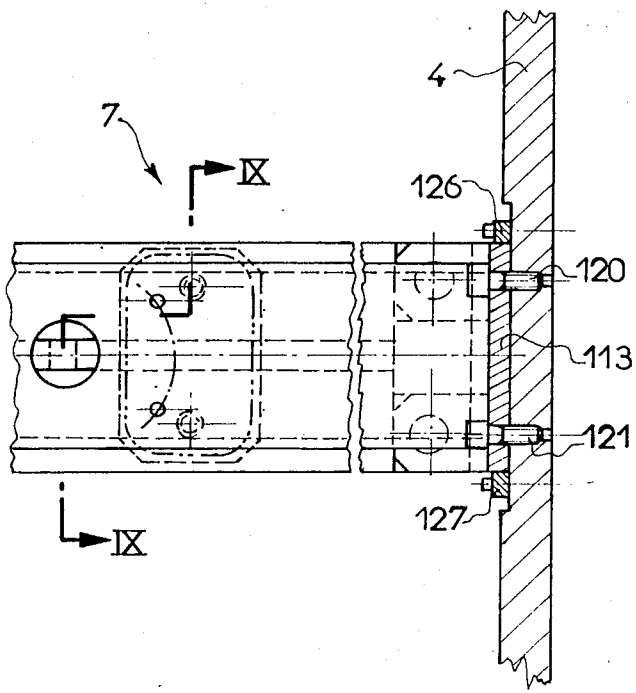
FIG. 8 is a sectional view of the assembly for pre-shaping and heating the edge of the section before the base is fitted.

FIGS. 8 and 9 depict the assembly 7 which, in the present embodiment, is intended for pre-shaping and heating. The assembly 7 includes on each side a support plate 113 having inlets 114, 115, 116, 117 through which retaining elements 118, 119, 120, 121 can pass making the support plate 113 firmly integrated with the supports 4. An adjusting element 122, retained within a bearing 123, is provided to effect and control sliding movement of the support plates 113 between bearings 124, 125, 126, 127, which are carried by the supports 4. The two support plates 113 are interlinked by a cross-piece 128 acting as support for a jack 129, preferably pneumatic, provided with a piston 130. The piston 130, passes through an orifice 131 in the cross-piece 128 and is connected to a thrust plate 132. The plate 132 is fitted with sleeves 133, 134 sliding along axes 135, 136 which, in turn, are supported by bearings 137, 138, 139, 140 carried by the support plates 113. On its face 141, facing the lengths of tubular section 101, the thrust plate 132 incorporates heating plates 142 linked to the thrust plate 132 by axes or shafts 143 and 144. The shafts 143 and 144 are rigidly connected to the heating plates 142 and are slidably received within holes 145, 146 in the thrust plate 132. Elastic elements 147, 148 are arranged between the thrust plate 132 and the heating plates 142 and surround the shafts 143, 144. When therefore, following operation of the jack 129, the heating plates 142 are applied against an edge 149 of the length 101, the elastic elements 147, 148, prevent the heating plates 142, as the result perhaps of too sudden a thrust, from damaging the edge 149 of the lengths 101. Contact between the heating plates 142 and the edge 149 of the lengths 101 to which the base is due to be fitted, may have a duration equal to or less than the assembly pause time for the drum 5. The drum 5 is again involved in a rotation of one sixth of a revolution and the different lengths 101 of a same series are placed before the adhesion assembly 8.

Figure 11:
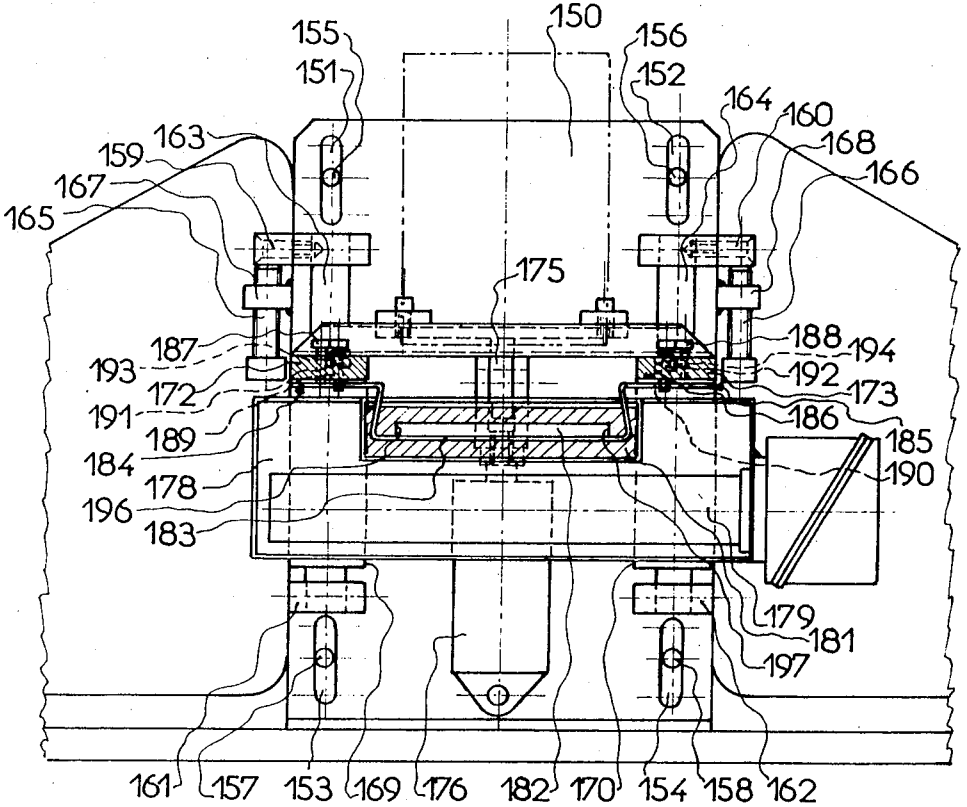
FIG. 11 is a view taken along the line XI—XI of FIG. 10.
Figure 10:
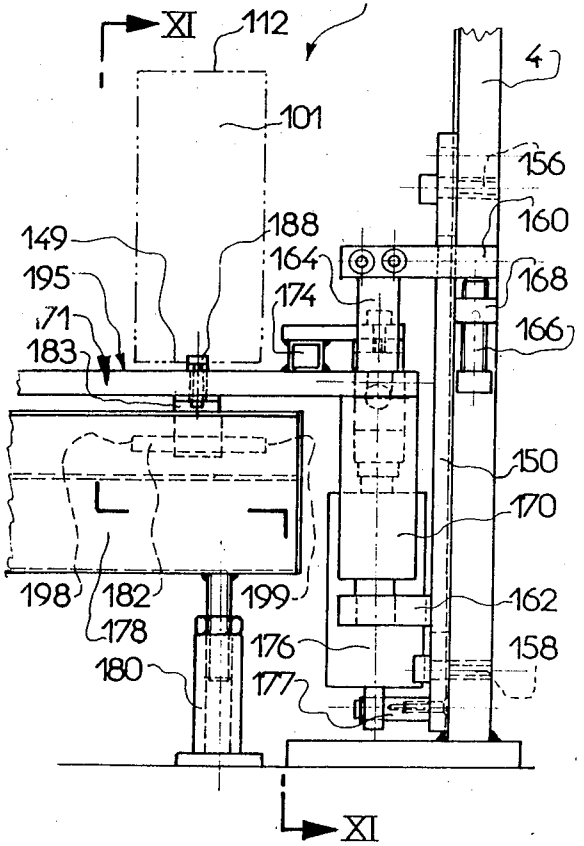
FIG. 10 is a sectional view of the adhesion assembly.

FIGS. 10 and 11 depict the adhesion assembly 8. In the present embodiment, the assembly 8 includes, on each side, a support plate 150 having inlets 151, 152, 153, 154 through which retaining elements 155, 156, 157, 158 are passed to provide a connection between the plates 150 and supports 4 of the frame 2. To this support plate 150 are affixed, by one means or other, bearings 159, 160, 161, 162 with which axes or shafts 163, 164 are engaged. The height of the support plates 150 may be adjusted by using adjusting elements 165, 166 which are held by bearings 167, 168 carried by the supports 4 acting upon the bearings 159, 160. Sleeves 169, 170 carried by a frame 171 slidably engage respective shafts 163 and 164. The frame 171 consists of two side members 172, 173 interconnected by two cross-pieces 174. The frame 171 is integral with the pistons 175 of two lateral jacks 176 held by a bearing 177 making the connection between the jacks 176 and the support plates 150.

An adhesive container 178 supported by feet 180 is placed between the jacks 176 and is fitted with at least one resistance heater 179. The adhesive container 178 includes an upper compartment 181 into which plates 182 are dipped supported by stirrups 183. The ends 184, 185 of the stirrups are integrated with the lower face 186 of the side members 172, 173 by retaining elements 187, 188 inserted into holes 189, 190 made in the said side members 172, 173. Elastic elements 191, 192 are passed over such retaining elements 187, 188 and engage in the housings 193, 194 provided in the upper part 195 of the side members 172, 173. As a result of operation of the jacks 176, the plates 182, having acquired a coating of adhesive the surplus from which oozes along plate edges 196, 197, 198, 199, are moved against the edge 149 of the lengths or sections 101. The elastic elements 191, 192 soften the impact of contact between the edge 149 and plates 182 and prevent the edge 149 of the lengths 101 from deteriorating. After having coated the edge 149 of the lengths 101 with adhesive, the drum 5 is again made to rotate by one sixth of a revolution and the different lengths 101 are placed opposite the assembly 9 for inserting the bases.

FIGS. 12 and 13 depict the assembly 9 adapted for inserting bases derived from a number of stock bins 200. The stock bins 200 consist of vertical columns 201, 202, 203, 204 protecting the bases and integral with two connecting plates 205, 206. The connecting plates are supported by crosspieces 207, 208 having inlets 209, 210, 211, 212 through which retaining elements 213, 214, 215, 216 pass to connect the stock bin assembly 200 with the supports 4 of the frame 2. The storage bins 200 are placed above a table 217 fitted with stiffeners 218 219 and two crosspieces 220 and 221. The crosspieces 220 and 221 are each provided with inlets 222, 223 respectively through which retaining elements 224, 225 pass to connect the table 217 and the supports 4 of the frame 2. The table 217 acts as a support for two jacks 226 placed close to the supports 4. The pistons 227 of the jacks 226 are fitted with a thrust plate 228 extending from one piston to the other. The thrust plate 228 includes at each end a sleeve 229 sliding on an axis or shaft 230 supported by bearings 231, 232 which are firmly integrated with and carried by the table 217. Near to the lower opening 233 of the storage bins, guides 234, 235 are provided for lateral guiding of the bases. The table 217 and the guides 234, 235 have a curved end 236, 237 interacting with a guiding metal plate 238. The plate 238 has a crosspiece 239 firmly integrated with retaining plates 240. The plates 240 are provided with an inlet 241 through which a retaining element 242 is passed to form a connection between the guiding metal plate 238 and the supports 4 of the frame 2. By such interaction, the bases emanating from the stock bins 200 are directed towards the assembly 9.

The assembly 9 includes, on each side, a support plate 243 having inlets 244, 245, 246, 247 through which retaining elements 248, 249, 250, 251 pass to make the support plate 243 firmly integrated with supports 4 of the frame 2. By means of an adjusting element 252, supported by a bearing 253, it is possible to advance or withdraw the plate supports 243 sliding between abutments 254, 255, 256, 257 which are firmly integrated with the supports 4. The two support plates 243 are interlinked by a crosspiece 258 providing support for a jack 259, preferably pneumatic. Jack 259 has a piston 260 which passes through an orifice 261 in the crosspiece 258 and is connected to a thrust plate 262. The plate 262 is fitted with sleeves 263, 264 sliding on shafts 265, 266. These latter shafts are supported by bearings 267, 268, 269, 270 which are firmly integrated with support plates 243. The plate 262 is also provided with a face 271, facing the lengths of tubular section 101. Centering plates 272 are linked to the thrust plate 262 by shafts 273, 274 which are firmly integrated with the centering plates 272. Pressure plate 262 is provided with holes 275, 276 to receive the shafts 273, 274 respectively. Elastic elements 277, 278 fit over the respective shafts 273 and 274 between the thrust plate 262 and the centering plates 272.

In operation, the jack 259 causes the centering plates 272 with a base 279 to be applied against the edge 149 supplied with adhesive from the length 101. Under these conditions, the elastic elements 277, 278 prevent deterioration either of the bases 279 or of the edges 149 of the lengths 101. The centering plates 272 are guided by a pair of lateral guides 281 and include abutments 280 against which the bases 279 abut.

Figure 15:
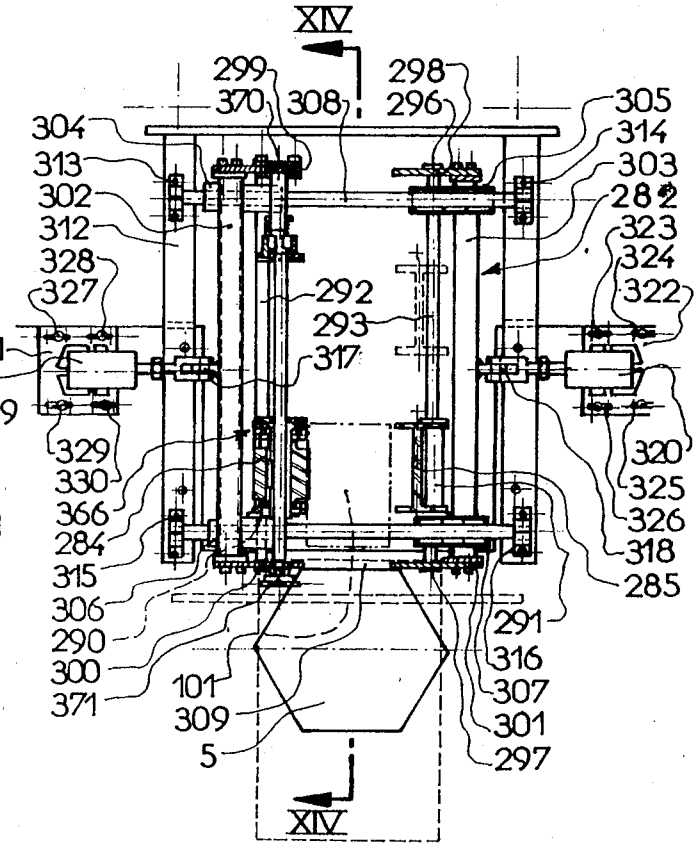
Figure 14:
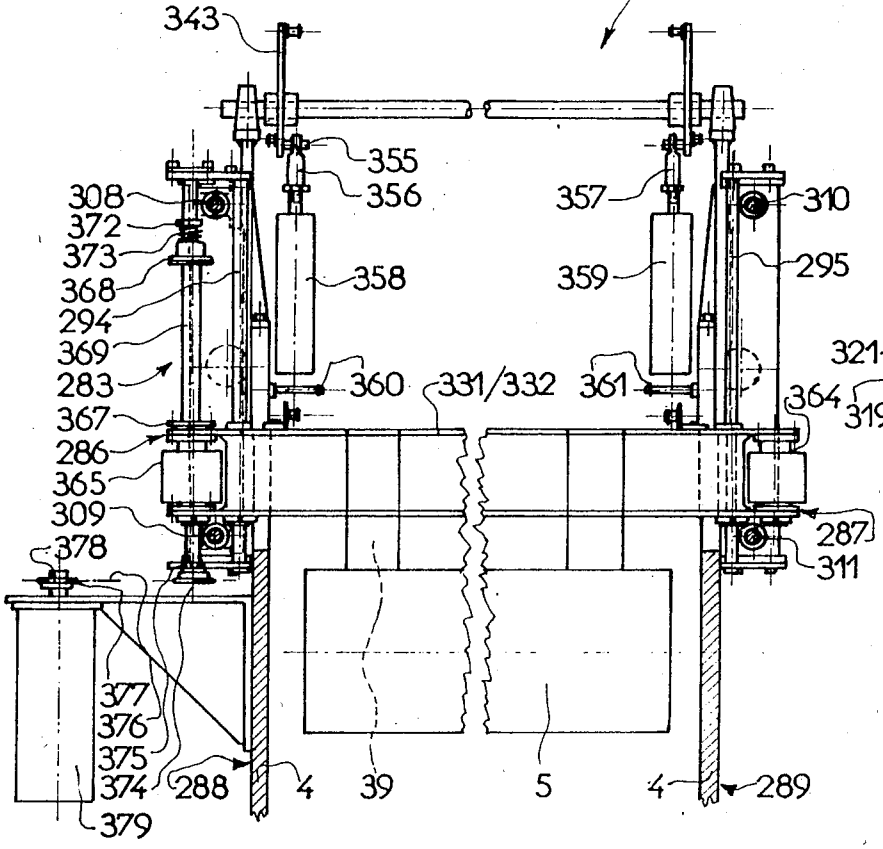
FIG. 14 is a view taken along the line XIV—XIV of FIG. 15.

FIGS. 14, 15, and 16 depict the discharge assembly 11 for lengths of tubular section 101 fitted with a base 279. Before this assembly 11 can function, the gripping facilities 39 are brought back to their rest position, that is to say, the piston 84 is withdrawn and consequently the spacer 81 is brought back to the low position. The different elastic elements 76 operate and bring the upper ends 88, 89 of the vertical axes or supports 56 to 59 closer together. For this reason, the latter are no longer supported against the inside wall of the lengths of tubular section 101 and it is possible to withdraw them from the gripping facilities 39.

The assembly 11 consists of two devices 282, 283, a first one of which, i.e., 282, raises lengths of tubular section 101 fitted with the base 279 in order to separate them from the gripping facilities 39, while the other one, 283, effects discharge of the series of lengths 101.

The first device 282 includes two crosspieces 284, 285 the ends 286, 287 of which protrude in relation to the outside face 288, 289 of the supports 4 and have a sleeve 290, 291 which can slide on four shafts 292, 293, 294, 295 arranged at each end of each crosspiece. The upper end 296 and lower end 297 of each of the shafts 292 to 295 traverse supports 298, 299, 300, 301 firmly integrated with connecting beams 302, 303. The beams 302, 303 slide on ball bearing sleeves 304, 305, 306, 307 mounted on shafts 308, 309, 310, 311 firmly integrated with a support frame 312 by means of bearings 313, 314, 315, 316. The connecting beams 302, 303 are activated by pistons 317, 318 of the preferably pneumatic jacks 319, 320 mounted on plates 321, 322. The plates 321, 322 have inlets 323, 324, 325, 326 through which are passed retaining elements 327, 328, 329, 330 providing connection between the plates 321, 322 and the supports 4 of the frame 2. The jacks 319, 320 act upon the beams 302, 303 to bring crosspieces 284, 285 (FIGS. 14 and 16) near to the lengths 101. Crosspieces 284, 285 are provided with endless belts 331, 332 resting against the lengths 101. The crosspieces 284, 285 are held by stirrups 333, 334 at the lower ends 335, 336 of rods 337, 338 of which the upper end 339, 340 is connected by an articulating axis 341, 342 to levers 343, 344.

One of the levers 344 has two legs 345, 346 which are substantially perpendicular to one another. One of the legs 345 is linked by means of the articulating axis 342 to the upper end 340 of the rod 338. The other leg 346 is linked by an articulating axis 347 to one of the ends 348 of a connecting rod 349. The other end 350 of the rod 349 is linked by an articulating axis 351 to the other lever 343. The lever 343 comprises three legs 352, 353, 354. Two legs 352, 354 extend in substantially opposite directions while the third leg 353 forms a certain angle with the other two. The leg 353 is linked by the articulating axis 351 to the end 350 of the connecting rod 349. The leg 354 is linked by the articulating axis 341 to the upper end 339 of the rod 337, and the leg 352 is linked by an articulating axis 355 to the piston 356, 357 of jacks 358, 359, preferably pneumatic. The jacks are linked by connecting shafts 360, 361 to the supports 4 of the frame 2. The jacks 358, 359 make it possible to raise the crosspieces 284, 285 from their low position 362 to their high position 363. When this happens, the lengths 101 are released from the gripping devices 39.

The second device 283 comprises essentially the two endless belts 331, 332 each rolling in part around a driven drum 364 and a driving drum 365. The driving drum 365 includes on its upper part 366 a clutch element 367 interacting, when the crosspieces 284, 285 are in the high position 363, with a second clutch element 368 firmly integrated in rotation with a drive shaft 369. The shaft 369 is supported by upper bearings 370 and lower bearings 371 resting in the supports 298, 299, 300, 301. An elastic element 373 is placed between a stop 372 mounted on the drive shaft 369 and the clutch element 368. Placed at the lower end 374 of the drive shaft 369 is a driven pinion 375 which is linked by means of a chain 376 to a drive pinion 377 mounted on the shaft 378 of a motor 379. The bore of the driving drum 365 is greater than the diameter of the drive shaft 369 and for this reason, the drive drum 365 can slide along the drive shaft 369.

The operation of the discharge assembly 11 is as follows: through the operation of jacks 319 and 320 the endless belts 331, 332 are brought near to the series of lengths 101 so as to touch the lengths 101. The jacks 358, 359 are then activated to cause the endless belts 331, 332 to lift up the different lengths 101 fitted with the base 279. Simultaneously, rotation of the drive shafts 369 is initiated. When the endless belts 331, 332 are in the high position and the various lengths 101 are disengaged from the gripping facilities 39 of the drum 5, the driving drums 365, by interaction of the two clutch elements 367, 368, are driven and, in their turn, drive the endless belts 331, 332. The latter drive the series of lengths 101 and the said lengths 101 are discharged from the machine 1.

According to the material used to make the lengths of tubular section, a number of the peripheral assemblies 6-11 can be replaced by other such assemblies, to facilitate other modes of attachment of the base, such as by crimping, and/or when the dimensions of the lengths and/or their cross-section vary. With reference to FIG. 17, there is shown the drive assembly for shaft 29 and, in consequence, for drum 5 (see also FIGS. 2 and 3). The drive assembly includes a brake motor 380 mounted on a support 382 and having a shaft 381. A variable drive pulley 383 is mounted on the shaft 381 and linked by a strap 384 to a variable driven pulley 385 firmly integrated in rotation with the entry shaft 386 of an indexer 387. The exit shaft 388 of such indexer 387 drives a coupling 389 of which one of the flanges 390 is firmly integrated in rotation by the key 34 with the shaft 29 of the drum 5. Ball bearings 391, mounted on the journal 33 of the shaft 29, are housed in a bearing 392 which is firmly integrated into one of the vertical supports 4. The same, of course, applies to the ball bearing mounted on the journal 31.

The above description has been given for a machine which seals a base and/or a lid on the edge of a length of tubular section of polygonal cross-section, such section being obtained by the adhesion of several strips of fibrous, cellulosic, metallic, plastic and other materials. Such sealing can be carried, out by cold process adhesion, by hot process adhesion and, in particular, by means of a therm-fusible film, either by high frequency welding, by ultrasonics, by conduction, rotation, by crimping or by any other means. It is possible, that by replacing different ones of the fixed assemblies 6 to 11 by other adequate assemblies, the same machine may be used for sealing a base and/or a lid on the edge of a length or section of circular cross-section, for example a box of cheese, a goblet or other cylindrical or truncated cone container the shell of which is obtained by adhesion of several strips of fibrous, cellulosic, metallic, plastic and other materials.

For this purpose, the gripping facilities firmly integrated with the flat surfaces 12 to 17 of the drum 5 (FIG. 17) include pneumatic or hydraulic jacks 396 having pistons 395. A cylindrical cap 393 is firmly integrated with and connected to the end 394 of pistons 395. In the operating phase, the cylindrical cap 393 protrudes in relation to a base plate 397 firmly integrated with the flat surfaces 12 to 17 by the axes or shafts 398, 399, 400. The number of gripping facilities, per flat surface 12 to 17, is a function of the number of boxes which it is desired to make per cycle. The base plate 397, of course, has a number of apertures 401 through which the cylindrical cap 393 passes. The number of apertures 401 is equal to the number of pneumatic jacks 396. The diameter of the apertures 401 is practically identical to the diameter of the cylindrical caps 393. The ring 402 formed by a length of tubular section of circular cross-section and acting as periphery of the final box, is slipped over the cylindrical cap 393. The edge 403 of the ring 402 is pressed against the base plate 397. It is preferable that the ring 402 be tightly adjusted to the cylindrical cap 393 in order that it remain in position. The positioning assembly for rings 402 on cylindrical caps 393 is shown in FIGS. 18 and 19. This assembly consists of a first device 403 to put the rings 402 opposite the cylindrical caps 393 and a second device 404 to slip such rings 402 onto the corresponding cylindrical caps 393.

The first device 403 comprises a drawer 405 offering a range of colors 406, 407, 408, across which, from a feed and storage magazine which is not shown, the rings 402 fall. The lower extremities 409 of the drawer 405 include a support unit 410 firmly integrating the drawer with two sliding axes or shafts 411. The upper extremities 412 of the drawer 405 have a retaining unit 413 providing a second connection between the drawer 405 and the sliding shafts 411. Ball bearing sleeves 414 are housed in cages 415, 416 and are slipped over the shafts 411. The cages 415, 416 are firmly integrated with a base 417 fixed to the inside face 418 of the vertical supports 4. By means of bearings 419, it is possible to adjust the height of the bases 417 which, on the one hand, changes the height of the first device 403 as a whole and may, on the other hand, adjust the angle of the drawer 405 to the horizontal. The latter is raised or lowered by a jack 420 having a piston 422 the end 421 of which is covered by a cap 423 and is connected by an axis 424 to a cap 425 which is firmly integrated with the top 426 of the drawer 405. The jack 420, which may be either pneumatic or hydraulic, is firmly integrated with a fixed beam 427 of which the ends 428 are firmly integrated with the cages 415. When the jack 420 is activated, the drawer 405 arranged the rings 402 opposite the cylindrical caps 393 so that the rings 402 rest upon positioning markers 429, 430 forming part of the second device 404.

The second device 404 comprises, on each side, a support plate 431 having inlets 432, 433, 434, 435 through which retaining elements 436, 437, 438, 439 are passed firmly integrating the support plate 431 with the vertical supports 4. A fixed beam 440 is perpendicular to the plate 431 and acts as support for a pneumatic or hydraulic jack 441. The fixed beam 440 has a hole 442 through which passes the piston 443 of a jack 441. The end 444 of the piston 443 is provided with a driver 445 extending from one vertical support 4 to the other. Adjusting plates 447, 448 for the positioning markers 429, 430 are fixed to the forward face 446 of the driver 445. When the rings 402 rest upon the positioning markers 429, 430, the jack 441 is activated and acts upon the driver 445. The latter pushes the rings 402 and these slip over the cylindrical caps 393. When this occurs, the drum 5 rotates by one sixth of a revolution to present the series of rings 402 in front of an input and positioning assembly 449 for discs acting either as base or as lid for the ring 402.

The assembly 449 is depicted in FIGS. 20-22 and consists of three devices, one being a storage magazine, the second a disc by disc selection device and the third a device introducing the disc into the ring 402. The storage magazine 450 has compartments 451, 452 in which the discs 453 are housed. Each compartment 451, 452 is laterally bounded by two positioning guides 454, 455 sustained by vertical supports 456, 457. These supports are affixed to a forward crosspiece 458 and a rear crosspiece 459 of which the ends 460 are firmly integrated with the vertical supports 4 by bases 461. The bases 461 have elongated holes 462, 463 through which retaining elements 464, 465 are passed. Because of the elongated holes 462, 463, it is possible to bring the storage magazine 450 nearer to the drum 5 or move it further away. Each positioning guide 454 has an arrestor 467, 468 at that end 466 which points towards the drum, and the discs 453 lodge against these. The discs, arranged vertically, rest with their lower edge on an axis or shaft 469 sustained by bearings 470, 471 affixed on the crosspieces 458, 459. A ring 472, more particularly a ball bearing sleeve, fits over and rides along the shaft 469. Attached to the ring 472 are, on the one hand, a driver 473 which is pressed against the pile of discs 453 and, on the other hand, a driving support 474 in which there is a hole 475 through which a wire 476 is passed. One of the ends 477 of the wire 476 is connected to an axis 478. The wire 476 passes in part around two lazy pullies 479, 480. The other end 481 of the wire 476 is fitted with a counterweight 482 of such weight that the wire 476 exerts sufficient tractive force on the driver 473 to ensure that, on the one hand, the discs 453 are kept pressed against one another and, on the other hand, the disc pile is kept moving forward progressively as each disc is taken out. However, the tractive force is insufficient to overcome the resistance exerted by the arrestors 467, 468.

The device 483 selects each pile of discs 453 disc by disc and comprises a series of suction cups 484 facing the advancing end of the pile of discs 453 arranged in the compartments 451, 452 of the storage magazine 450. The suction cups 484 are arranged on a crosspiece 485 which is adapted to be moved forward or back. To this end, the two side ends 486 are firmly integrated with the end 487 of an axis or shaft 488 sliding through a ball bearing sleeve 489 housed in a fixed cage 490 which is firmly integrated with a base 491. The base 491 has elongated holes 492, 493 through which retaining elements 494, 495 are passed firmly integrating the base 491 with the vertical supports 4. Adjusting facilities 496, 497 adjust the height of the device 483 as a whole. The other end 498 of the axis or shaft 488 is linked by a toggle 499 to the end of the piston 501 of an hydraulic or pneumatic jack 502 which is firmly integrated with the base 491. The jack 502 first exerts a tractive force upon the crosspiece 485. For this reason, the suction cups 484 are pressed against the center of the discs 453. The jack 502 next applies thrust to the crosspiece 485. The force of suction from the cups 484 acting with the elasticity of the disc 453 overcomes the resistance exerted by the arrestors 467, 468 and the disc is detached from the pile of discs arranged in the compartments 451, 452. The suction cups 484 direct the discs 453 through the guides 503 towards means 504 for introducing the discs 453 into the rings 402.

The introducing means 504 includes a series of centering tools 505 each having a slot 506 to position the discs 453. A pusher 507 is fixed on a shaft 508 firmly integrated with a moving beam 509 so as to slide inside the tool 505. Between the rear face of the centering tool 505 and the forward face of the moving beam 509 are placed elastic elements 510, 511 of which the ends 512, 513 are firmly integrated respectively with the rear face of the centering tool 505 and the forward face of the moving beam 509. On the end of the rear face 514 of the moving beam 509 is fixed a shaft 515. The shaft 515 slides in ball bearing sleeves 516 which are housed in cages 517 firmly integrated with a base 518. The base 518 has elongated holes 519, 520, 521, 522 into which are fitted retaining elements 523, 524, 525, 526 fixing the bases 518 on the vertical supports 4. The two bases 518 are interlinked by a fixed beam 527 having a hole 528 through which slides the piston 529 of an hydraulic or pneumatic jack 530 which is firmly integrated with the fixed beam 527. The end 531 of the piston 529 is connected by a flange 532 to the moving beam 509. When the jack 530 is operated, the moving beam 509 goes forward in such a way that the centering tool 505, on resuming contact with the edge of the ring 402, is blocked by that edge. The jack 530, continuing its thrust, compresses the elastic elements 510, 511 and makes the pusher 507 slide. The latter pushes the disc 453 inside the ring 402. When the jack 530 is activated in the opposite direction, the moving beam 509 returns to its initial position. Thereafter, the drum 5 is rotated by a sixth of a revolution to present the series of rings 402, fitted with discs 453, opposite an adhesion assembly 533.

An adhesion assembly embodiment is depicted in FIGS. 23 and 24, and includes a container 534 divided into two compartments 535, 536 arranged one above the other. The lower compartment 535 contains the heating facilities, such as immersion resistances 537, while the upper compartment 536 contains the adhesive. The container 534 is supported by feet 538 provided with height adjusters 539. The feet are firmly integrated with the top of the base 3. Printing plates 540 are dipped into the upper drawer 536 from a vertically mobile frame 541. The frame 541, through an appropriate adhesion tool (not shown), is to deposit a layer of adhesive on the periphery of the disc 453 or on the rings 402. The plates 540 are firmly integrated with stirrups 542, 543 fixed to longitudinal beams 544, 545. Each longitudinal beam 544, 545 has, at each of its ends 546, a cage 547 fitted with a ball bearing sleeve 548. The cages 547 slide vertically along shafts 549 supported by bearings 550, 551 which are firmly integrated with a support plate 552. The plate 552 has elongated holes 553, 554, 555, 556 through which are passed retaining elements 557, 558, 559, 560 establishing a connection between the base 552 and the vertical support 4. The elongated holes 553 to 556 allow vertical displacement of the base 552, such displacement being effected by means of an adjusting element 561. The base 552 has a second regulating element 562 which can adjust the positioning of adjustable stops 563 to restrict vertical displacement of the movable device 541.

Vertical movement of the mobile device 541 is effected by pneumatic or hydraulic jacks 564 firmly integrated through an axis 565 with the vertical support 4. The end 566 of the piston 567 of such jacks 564 is firmly integrated by means of a cap 568 with a crosspiece 569, of which the ends 570, 571 are firmly integrated with the longitudinal beams 544, 545. After the perimeter of the discs 453 and/or the rings 402 have been coated with adhesive, the drum 5 is again rotated by one sixth of a revolution to present the series of rings 402, fitted with discs 453 coated with adhesive, opposite a pre-crimping assembly 572.

One embodiment of a suitable pre-crimping assembly 572 is depicted in FIGS. 25 and 26. There is shown a fixed beam 573 of which the ends 574 are firmly integrated with the bases 575. The bases 575 have elongated holes 576, 577, 578, 579 through which retaining elements 580, 581, 582, 583 can be passed, firmly integrating the bases 575 with the vertical supports 4. The inside face 584 of the fixed beam 573 has two cages 585, 586 in which ball bearing sleeves 587, 588 are housed. Through the latter, shafts 589, 590 slide vertically, their upper ends being sustained by respective retaining elements 593, 594 in bearings 595, 596. The bearings 595, 596 are firmly integrated with the lower face 597 of a movable beam 598. The top 599 of this movable beam 598 has shafts 600, 601, onto which are slipped respective tools 602, 603 suitable for pre-crimping. The tools 602, 603 may be provided with resistances 604, 605 to facilitate adhesion The movable beam 598 may be raised or lowered using two pneumatic or hydraulic jacks 606, 607 having respective pistons 610 and 611. Corresponding piston ends 608 and 609 are connected to the movable beam 598 by flanges 612, 613. The body of the jacks 606, 607 is firmly integrated with the inside face 584 of the fixed beam 573.

After pre-crimping, the drum 5 is again rotated by one sixth of a revolution to present the pre-crimped boxes opposite a final crimping assembly. However, this assembly is practically identical with the pre-crimping assembly described above, except that the tools appropriate to pre-crimping are replaced by tools appropriate to final crimping. After final crimping, the drum 5 is given a last rotation of one sixth of a revolution to present the finished boxes opposite a discharge assembly 614.

One embodiment of a suitable discharge assembly is shown in FIGS. 27 and 28. There is shown a fixed support 615 of which the ends 616 are firmly integrated by retaining elements 618 with the upper ends 617 of vertical supports 4. Cages 620 are attached to the top 619 of the support 615 and act as housing for ball bearing sleeves 621 through which shafts 622 slide vertically. The lower ends 623 of the shafts 622 are held in bearings 624 by retaining elements 625. The bearings 624 are firmly integrated with the top 626 of a discharge tunnel 627. The tunnel 627 is of U-shaped cross-section with the open part facing downwards. The tunnel 627, covering the series of finished boxes, is extended at one end 629 by an exit slipper guide 630 while the other end is fitted with a compressed air jet (not shown). The tunnel 627 is subject to vertical displacement. To this end, the top 626 of the tunnel 627 is fitted with flanges 631 connected by an axis 632 to flanges 633 which are firmly integrated with the end 634 of pistons 635 of pneumatic or hydraulic jacks 636. The body of the jacks 636 is firmly integrated with the top 619 of the fixed support 615.

In operation, as the drum 5 rotates, the tunnel 627 is in the high position. When it stops, the tunnel 627 is lowered so that the edges 637, 638 of the vertical legs 639, 640 rest on the base plate 397 of the gripping facilities described above. The jacks 396 are then acted upon in such a way that the cylindrical caps 393 are removed from inside the base plate 397. As a result, the boxes rest on the top of the base plate 397. The compressed air jet is activated and the boxes are pushed by the air stream in the direction of the exit slipper guide 630. After discharge, the tunnel 627 is raised and the drum 5 can turn again.

Although the invention has been described in relation to a particular embodiment, it is not restricted to the embodiment described and various changes can be made by those skilled in the art in the forms, materials and combinations of such diverse elements without departing from the scope of the invention.

What is claimed is:

1. Apparatus for applying a sealing material to the edge of a length of packaging formed from strips of selected materials, the apparatus comprising a frame having a base enclosure and a pair of substantially parallel vertically extending supports, each connected at one end of the base, the improvement comprising a rotatable drum carried between the supports and having a polygonal cross-section defining a plurality of peripheral facets, means associated with each of said facets for holding the packaging, a plurality of fixed operational assemblies interchangeably mounted substantially concentrically around and proximate to the periphery of said drum, whereby packaging carried by said drum may be steps from one of said assemblies to another to apply and secure the sealing material thereto, each of said holding means comprising a duct for carrying a fluid under pressure, a plurality of jacks operatively communicating with the duct and receiving the fluid under pressure, and a plurality of assemblies of vertical axes such vertical axes, made of flexible materials and supported by a central retaining element, having on the one hand, at their lower end a machined-down part and, on the other hand, a flat part facing the jacks and provided with horizontal bearings the opposite surface of which have an inclined face interacting by a camming action with a spacer which is firmly integrated with the end of the pistons of the jacks, wherein insertion of the spacer between the bearings causes the bearings to move apart, the bearings opposite one another being interlinked by an elastic element to bring back the vertical axes by elastic action to the release position when the spacer is withdrawn.

2. The apparatus of claim 1, in which one of said assemblies is adapted to present packaging to the drum and comprises a supporting frame fixed on a metal sheet provided with guides between which the packaging is positioned under the guidance of a guide channel made of walls which can be brought nearer together and moved further apart according to the dimensions of the packaging and to a slipper guide directing the packaging between the guides, and a pneumatic jack firmly integrated with the metal sheet, the piston of which is provided with a driver arranging the packaging on the drum in such a way that the packaging slips onto the assemblies of vertical axes.

3. The apparatus of claim 2, in which another of said assemblies is adapted for pre-shaping and heating the packaging onto which a base will be sealed and comprises, on each side, an adjustable support plate which is firmly integrated with the supports of the frame and interlinked by a crosspiece acting as a support for one of the jacks, said one of the jacks having a piston operatively coupled thereto and passing through a hole in the crosspiece, the piston being provided with a thrust plate having sleeves sliding on axes supported by bearings which are firmly integrated with support plates, and having heating plates on its face facing the lengths of tubular section.

4. The apparatus of claim 3, characterized by the fact that the heating plates are linked to the thrust plate by axes firmly integrated with the heating plates but sliding through holes in the thrust plate such axes including elastic elements fitted between the thrust plate and the heating plates to ease contact between the heating plates and the edge of the lengths.

5. Apparatus for applying a sealing material to the edge of a length of packaging formed from strips of selected materials, the apparatus comprising a frame having a base enclosure and a pair of substantially Parallel vertically extending supports, each connected at one end of the base, the improvement comprising a rotatable drum carried between the supports and having a polygonal cross-section defining a plurality of peripheral facets, means associated with each of said facets for holding the packaging, a plurality of fixed operational assemblies interchangeably mounted substantially concentrically around and proximate to the periphery of said drum, whereby packaging carried by said drum may be stepped from one of said assemblies to another to apply and secure the sealing material thereto, one of said assemblies, being an adhesion assembly depositing a film of adhesive on the end of the lengths, comprising at least one side, an adjustable support plate mounted on said at least one side and firmly integrated with the supports of the frame, and a second frame activated by two lateral jacks and an adhesive container, the second frame made of two side members interlinked by two crosspieces, having at its ends sleeves sliding along axes supported by bearings firmly integrated with the support plates, the adhesive container being fitted with at least one resistance heater and supported by feet and comprising an upper compartment into which are dipped plates supported by stirrups, the surplus adhesive oozing along the edges of the plates.

6. The apparatus of claim 5, characterized by the fact that, on the one hand, the lower face of the side members has stirrups fitted with plates transferring a film of adhesive from the adhesive container to the edge of the lengths and, on the other hand, the stirrups having ends that are firmly integrated with the lower face of the side members by retaining elements firmly integrated with the ends of the stirrups but sliding in the holes in the said side pieces, such retaining elements having elastic elements engaged in the housings arranged in the top of the side pieces to soften the impact of contact between the plates and the edge of the lengths.

7. The apparatus of claim 5, characterized by the fact that the container includes at its ends, sleeves sliding on axes supported by bearings firmly integrated with support plates fitted with adjusting elements.

8. Apparatus for applying a sealing material to the edge of a length of packaging formed from strips of selected materials, the apparatus comprising a frame having a base enclosure and a pair of substantially parallel vertically extending supports, each connected at one end of the base, the improvement comprising a rotatable drum carried between the supports and having a polygonal cross-section defining a plurality of peripheral facets, means associated with each of said facets for holding the packaging, a plurality of fixed operational assemblies interchangeably mounted substantially concentrically around and proximate to the periphery of said drum, whereby packaging carried by said drum may be stepped from one of said assemblies to another to apply and secure the sealing material thereto, one of said assemblies being adapted to position the sealing material, said one of said assemblies comprising a number of storage magazines made up of vertical columns protecting the sealing material and of which the lower opening gives onto a table fitted with guides and having a curved end interacting with a guiding metal plate to direct the sealing material towards the assembly for positioning the sealing material, such table acting as support for two jacks of which the piston is provided with a thrust plate directing the sealing material from the storage magazines towards the assembly for positioning the sealing material, having at each end a sleeve sliding on an axis supported by bearings firmly integrated with the table, said one of said assemblies further comprising, on each side, a support plate firmly integrated with the supports of the frame, a jack having a piston passing through an orifice in a crosspiece interlinking the support plates and connected to a thrust plate, the jack being provided, on the one hand with sleeves sliding along axes supported by bearings firmly integrated with support plates and, on the other hand, on its face facing the lengths, with centering plates linked to the thrust plate by axes firmly mounted to the centering plates but sliding through holes in the thrust plate, the axes including elastic elements fitted between the thrust plate and the centering plates to soften the contact between the sealing material and the edge of the lengths, such centering plates having abutments and two lateral guides between which the sealing material from the storage magazines positions itself.

9. Apparatus for applying a sealing material to the edge of a length of packaging formed from strips of selected materials, the apparatus comprising a frame having a base enclosure and a pair of substantially parallel vertically extending supports, each connected at one end of the base, the improvement comprising a rotatable drum carried between the suoports and having a polygonal cross-section defining a plurality of peripheral facets, means associated with each of said facets for holding the packaging, a plurality of fixed operational assemblies interchangeably mounted substantially concentrically around and proximate to the periphery of said drum, whereby packaging carried by said drum may be stepped from one of said assemblies to another to apply and secure the sealing material thereto, one of said assemblies being adapted for discharging lengths fitted with the sealing material and comprising first and second devices working together, the first device lifting the lengths of tubular section fitted with the sealing material in order to separate them from the gripping facilities, and the second device effecting discharge properly so-called of the series of lengths fitted with the sealing material, the first device comprising two crosspieces interacting with transfer facilities which move the two crosspieces relative to the lengths to be taken out, such transfer facilities being jacks firmly integrated with the supports of the frame, the jacks having pistons which act upon connecting beams slidding on ball bearing sleeves mounted on shafts firmly integrated with a supporting frame.

10. The apparatus of claim 9, characterized by the fact that the connecting beams comprise supports through which axes pass providing connection between the beams and the crosspieces, such crosspieces on the one hand, having an endless belt working with the series of lengths fitted with a base which are due for discharge, such endless belts winding part way around a driven drum and a driving drum and on the other hand, at each of their ends, a sleeve sliding on axes and interacting with lifting facilities to release the lengths fitted with a base from the gripping facilities.

11. The apparatus of claim 10, characterized by the fact that the lifting facilities are two jacks firmly integrated with supports of the frame, the jacks having pistons which act through levers and rods on the crosspieces, the lever comprising three legs, two in prolongation one of the other and the third making a certain angle with the other two, the leg being linked to the piston of the jacks, the leg being linked by the rod to the crosspiece and the leg being linked by the connecting rod to the other lever for simultaneous operation of the two levers and by the same jack and comprising two legs practically perpendicular to one another, of which the one is linked by the connecting rod to the lever and the other is linked by the rod to the second crosspiece.

12. Apparatus for applying a sealing material to the edge of a length of packaging formed from strips of selected materials, the apparatus comprising a frame having a base enclosure and a pair of substantially parallel vertically extending supports, each connected at one end of the base, the improvement comprising a rotatable drum carried between the supports and having a polygonal cross-section defining a plurality of peripheral facets, means associated with each of said facets for holding the packaging, a plurality of fixed operational assemblies interchangeably mounted substantially concentrically around and proximate to the periphery of said drum, whereby packaging carried by said drum may be stepped from one of said assemblies to another to apply and secure the sealing material thereto, one of said assemblies being adapted for discharging lengths fitted with the sealing material and comprising first and second devices working together, the first device lifting the lengths of tubular section fitted with the sealing material, the first device comprising means of rotating the endless belts when the crosspieces are in the high position, such means being, on the one hand, drive shafts supported by bearings housed in the supports along which the drive drum slides, having a bore greater than the diameter of the drive shafts, the lower end of such drive shafts being linked by a transmission consisting of a driven pinion mounted on the lower end, a chain and a drive pinion to a motor and, on the other hand, a clutch consisting of a first element firmly integrated in rotation with the drive drum and of a second element firmly integrated in rotation with the drive motors, the interaction of the two elements occurring only when the crosspieces are in the high position.

* * * * *